US011378297B2

(12) United States Patent
Ikemiya

(10) Patent No.: US 11,378,297 B2
(45) Date of Patent: Jul. 5, 2022

(54) AIR CONDITIONER

(71) Applicant: Mitsubishi Electric Corporation, Tokyo (JP)

(72) Inventor: Keisuke Ikemiya, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 269 days.

(21) Appl. No.: 16/620,998

(22) PCT Filed: Aug. 24, 2017

(86) PCT No.: PCT/JP2017/030316
§ 371 (c)(1),
(2) Date: Dec. 10, 2019

(87) PCT Pub. No.: WO2019/038880
PCT Pub. Date: Feb. 28, 2019

(65) Prior Publication Data

US 2020/0200424 A1 Jun. 25, 2020

(51) Int. Cl.
*F24F 11/77* (2018.01)
*F24F 11/64* (2018.01)
*F24F 140/20* (2018.01)

(52) U.S. Cl.
CPC ..... *F24F 11/77* (2018.01); *F24F 11/64* (2018.01); *F24F 2140/20* (2018.01)

(58) Field of Classification Search
CPC ..... F24F 11/77; F24F 11/64; F24F 2140/20; F24F 11/30; F24F 2110/10; Y02B 30/70
See application file for complete search history.

(56) References Cited

U.S. PATENT DOCUMENTS 7,185,504 B2 3/2007 Kasai et al.
2005/0268628 A1* 12/2005 Thompson ..... F25B 30/02 62/176.5

FOREIGN PATENT DOCUMENTS

JP 2003-194389 A 7/2003
JP 2013-137120 A 7/2013
JP 5814784 B2 * 11/2015
JP 2016-070574 A 5/2016
JP 2016070574 A * 5/2016
(Continued)

OTHER PUBLICATIONS

Japanese Office Action dated Jun. 9, 2020 for the corresponding JP application 2019-537499 (and English translation).
(Continued)

*Primary Examiner* — Chad G Erdman
(74) *Attorney, Agent, or Firm* — Posz Law Group, PLC

(57) ABSTRACT

Included is an indoor device including inside a casing an electrical-component box having electrical components accommodated therein, an indoor-device heat exchanger, and an indoor-device fan to deliver air to the indoor-device heat exchanger. An air conditioner includes a temperature measurement unit to measure a temperature of the indoor-device heat exchanger, and a control unit to determine an upper limit of a rotational speed of the indoor-device fan on the basis of a temperature of the indoor-device heat exchanger measured by the temperature measurement unit, and to execute control to operate the indoor-device fan at a rotational speed equal to or slower than the determined upper limit.

6 Claims, 9 Drawing Sheets

(56) References Cited

FOREIGN PATENT DOCUMENTS

WO WO-2013001829 A1 * 1/2013 ..... F25B 31/006

OTHER PUBLICATIONS

Chinese Office Action dated Nov. 27, 2020 for the corresponding CN application No. 201780094029.2 (and English translation).
International Search Report of the International Searching Authority dated Oct. 3, 2017 for the corresponding International application No. PCT/JP2017/030316 (and English translation).

* cited by examiner

41

| | | |
|---|---|---|
| PIPE TEMPERATURE OF INDOOR-DEVICE HEAT EXCHANGER | BELOW 45°C | 45°C OR HIGHER |
| MAXIMUM FAN ROTATIONAL SPEED | 1700rpm | 1600rpm |

FIG.8

42

| PIPE TEMPERATURE OF INDOOR-DEVICE HEAT EXCHANGER | BELOW 35℃ | 35℃ OR HIGHER TO BELOW 40℃ | 40℃ OR HIGHER TO BELOW 45℃ | 45℃ OR HIGHER |
|---|---|---|---|---|
| MAXIMUM FAN ROTATIONAL SPEED | 1900rpm | 1800rpm | 1700rpm | 1600rpm |

AIR CONDITIONER

CROSS REFERENCE TO RELATED APPLICATION

This application is a U.S. national stage application of International Patent Application No. PCT/JP2017/030316 filed on Aug. 24, 2017, the disclosure of which is incorporated herein by reference.

TECHNICAL FIELD

The present invention relates to an air conditioner that controls the rotational speed of an indoor-device fan provided in an indoor device.

BACKGROUND

The rotational speed of an indoor-device fan provided in an indoor device of an air conditioner is controlled on the basis of user-designated instruction information. When the air conditioner is determined to be in a state of over-capacity during air-conditioning operation, the indoor-device fan is controlled such that its rotational speed is reduced. Patent Literature 1 discloses a technique in which when the average temperature in the whole area of the room is higher than a set temperature during heating operation, the air conditioner is determined to be in a state of over-capacity of air conditioning, and thus a compressor and an indoor-device fan are controlled such that their rotational speeds are reduced.

In the air conditioner disclosed in Patent Literature 1, a heat exchanger, the fan, and a control unit are accommodated in a casing of the indoor device. In general, the control unit is accommodated in an electrical-component box located in the indoor device. During heating operation of the air conditioner, the temperature within the electrical-component box rises due to the influence of heat dissipated from the heat exchanger. When the fan is operated, heat is generated due to a load current. That is, when the fan is operated, energy loss in which electric energy is changed to thermal energy by a winding resistance is caused inside a motor that drives the fan. This is so-called copper loss and causes heat generation. In order to increase the heating capacity, the rotational speed of the fan is increased such that the air volume of the fan is increased. As the air volume is increased, a load current of the fan is increased. This results in a rise in temperature within the electrical-component box.

PATENT LITERATURE

Patent Literature 1: Japanese Patent Application Laid-open No. 2003-194389

When the air conditioner disclosed in Patent Literature 1 mentioned above is determined to be in a state of over-capacity of air conditioning, the indoor-device fan is controlled such that its rotational speed is reduced. However, the rotational-speed control executed on the fan does not take into account the rise in temperature within the electrical-component box in the indoor device. Therefore, there is a possibility that the temperature of electrical components within the electrical-component box rises, and eventually rises to the rated temperature or higher.

SUMMARY

The present invention has been achieved in view of the above, and an object of the present invention is to provide an air conditioner that includes an indoor device in which an electrical-component box having electrical components accommodated therein, a heat exchanger, and an indoor-device fan are accommodated within the same casing, and that is capable of suppressing a rise in temperature of the electrical components within the electrical-component box.

An air conditioner according to an aspect of the present invention includes an indoor device including inside a casing an electrical-component box having electrical components accommodated therein, an indoor-device heat exchanger, and an indoor-device fan to deliver air to the indoor-device heat exchanger. The air conditioner includes a temperature measurement unit to measure a temperature of the indoor-device heat exchanger and a control unit to determine an upper limit of a rotational speed of the indoor-device fan on a basis of a temperature of the indoor-device heat exchanger measured by the temperature measurement unit, and to execute control to operate the indoor-device fan at a rotational speed equal to or slower than the determined upper limit.

The air conditioner according to the present invention has an effect where it is possible to suppress a rise in temperature of electrical components within an electrical-component box, in an indoor device in which the electrical-component box having the electrical components accommodated therein, a heat exchanger, and an indoor-device fan are accommodated within the same casing.

BRIEF DESCRIPTION OF DRAWINGS

FIG. 8 is a diagram illustrating an example of a data table according to a second embodiment of the present invention.

DETAILED DESCRIPTION

An air conditioner according to embodiments of the present invention will be described in detail below with reference to the accompanying drawings. The present invention is not limited to the embodiments.

First Embodiment

Figure 1:
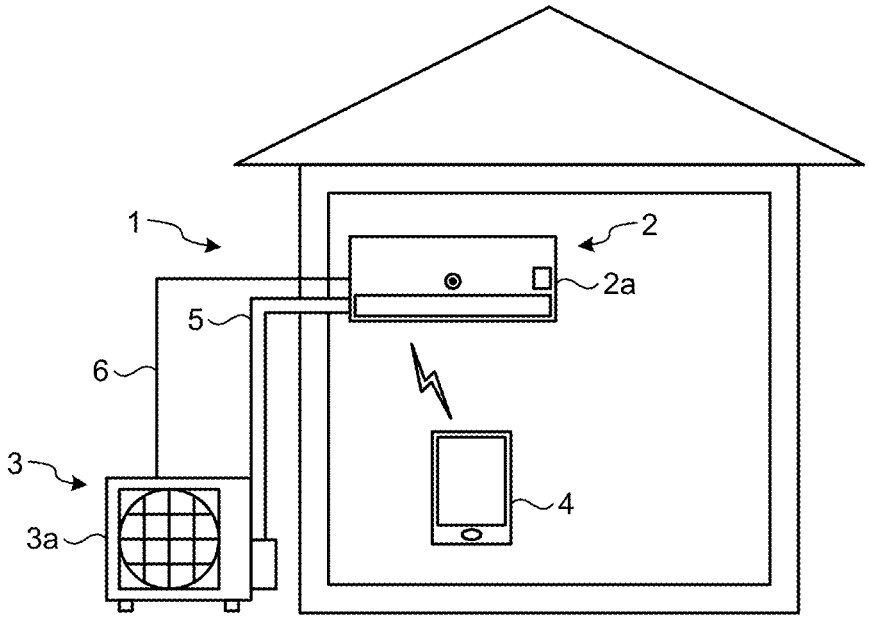
FIG. 1 is a configuration diagram schematically illustrating a configuration of an air conditioner according to a first embodiment of the present invention.

FIG. 1 is a configuration diagram schematically illustrating a configuration of an air conditioner 1 according to a first embodiment of the present invention.

Figure 2:
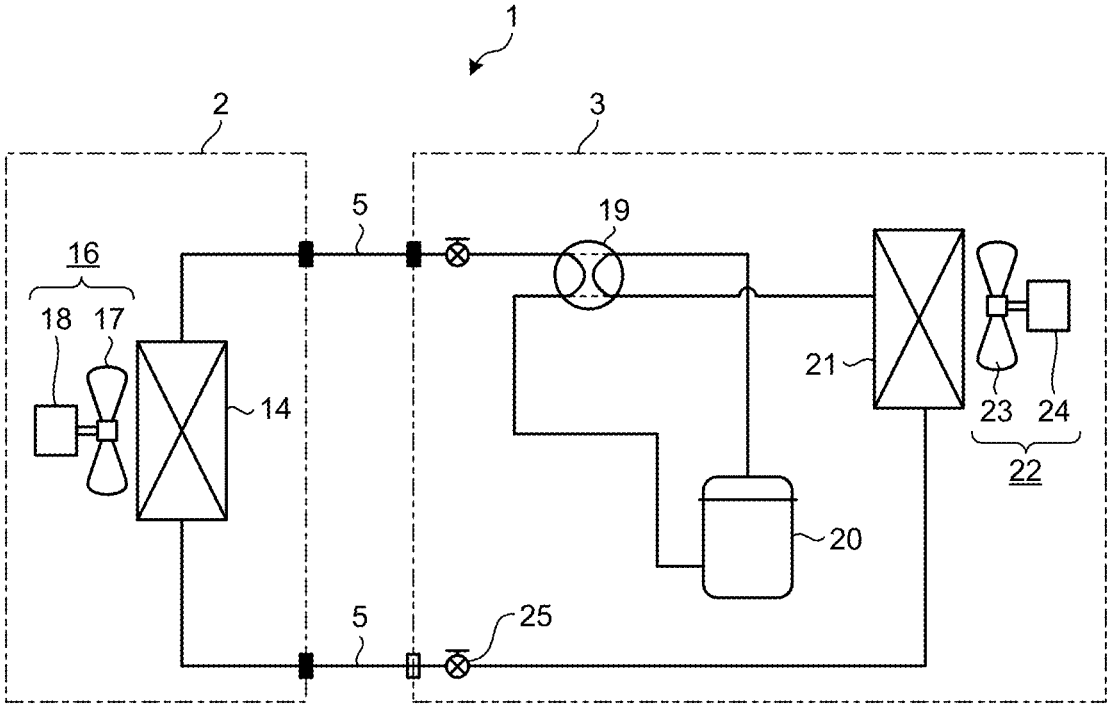
FIG. 2 is a refrigerant circuit diagram of the air conditioner according to the first embodiment of the present invention.
Figure 3:
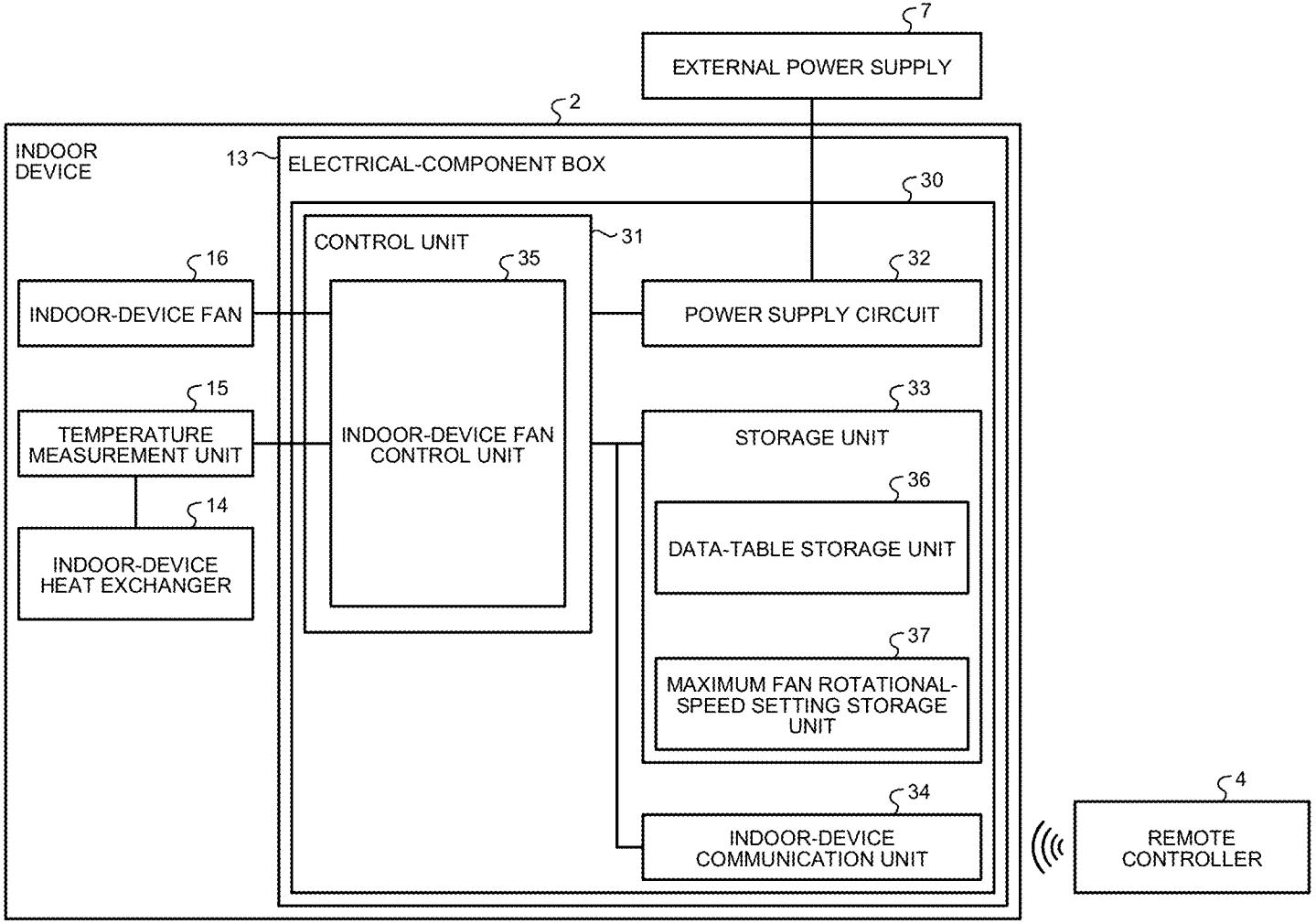
FIG. 3 is a functional block diagram related to operational control on an indoor-device fan in an indoor device of the air conditioner according to the first embodiment of the present invention.

FIG. 2 is a refrigerant circuit diagram of the air conditioner 1 according to the first embodiment of the present invention. FIG. 3 is a functional block diagram related to operational control on an indoor-device fan 16 in an indoor device 2 of the air conditioner 1 according to the first embodiment of the present invention.

As illustrated in FIG. 1, the air conditioner 1 according to the first embodiment includes the indoor device 2 including a casing 2*a* and located indoors, an outdoor device 3 including a casing 3*a* and located outdoors, a remote controller 4 that remotely controls operation of the air conditioner 1, and a refrigerant pipe 5 through which a refrigerant circulates between the indoor device 2 and the outdoor device 3. The outdoor device 3 is capable of communicating with the indoor device 2 through a communication line 6. Hereinafter, the remote controller is also referred to as "remote".

As illustrated in FIG. 2, the air conditioner 1 according to the first embodiment has a refrigeration cycle through which a refrigerant circulates. In the refrigeration cycle, a compressor 20, a four-way valve 19 that changes the flow direction of the refrigerant, an outdoor-device heat exchanger 21 installed in the outdoor device 3, an expansion valve 25 that is an expansion device, and an indoor-device heat exchanger 14 installed in the indoor device 2 are connected in the described order by the refrigerant pipe 5. The four-way valve 19 changes the flow direction of the refrigerant in the refrigerant cycle to switch between heating operation and cooling operation.

As the main constituent elements of the indoor device 2, an electrical-component box 13 in which electrical components are accommodated, the indoor-device heat exchanger 14 that is an indoor-side heat exchanger to which the refrigerant pipe 5 is connected, a temperature measurement unit 15 that measures the temperature of the indoor-device heat exchanger 14, and the indoor-device fan 16 that generates airflow that passes through the indoor-device heat exchanger 14 are located in the casing 2*a*.

The electrical-component box 13 has accommodated therein a control substrate 30 for driving and controlling constituent elements provided in the indoor device 2, examples of the constituent elements including an indoor-device fan motor 18, a display device (not illustrated) that displays an operational state of the air conditioner 1, and a light-receiving substrate (not illustrated) for performing infrared communication with the remote controller 4.

The control substrate 30 is constituted of a control unit 31 that controls operation of the air conditioner 1, a power supply circuit 32 that generates a power supply dedicated to operating the constituent units inside the indoor device 2, a storage unit 33 that stores therein various types of information to be used for controlling the air conditioner 1, and an indoor-device communication unit 34.

The power supply circuit 32 converts power supplied from an external power supply 7 outside the indoor device 2 to generate a power supply dedicated to operating each of the constituent units inside the indoor device 2. The power supply circuit 32 is connected to each of the constituent units inside the indoor device 2 by a power supply line. FIG. 3 omits illustrations of a part of the power supply line.

The storage unit 33 has stored therein various types of information to be used in air-conditioning operation of the air conditioner 1. The storage unit 33 includes a data-table storage unit 36 and a maximum fan rotational-speed setting storage unit 37 which are described later.

The indoor-device communication unit 34 receives information transmitted from the remote controller 4 and transmits the information to the control unit 31. The indoor-device communication unit 34 also transmits information transmitted from the control unit 31 to the remote controller 4. Examples of the communication method between the indoor-device communication unit 34 and the remote controller 4 include infrared communication. The communication method between the indoor-device communication unit 34 and the remote controller 4 is not limited to the infrared communication, but may be any method as long as the indoor-device communication unit 34 and the remote controller 4 can communicate with each other.

The control unit 31 controls operation of the air conditioner 1. By controlling operation of the indoor device 2 and the outdoor device 3, the control unit 31 controls running of the air conditioner 1. The control unit 31 can transmit information to the remote controller 4 through the indoor-device communication unit 34. The control unit 31 controls the operation of the air conditioner 1 on the basis of various types of information related to running of the air conditioner 1, such as instruction information received from the remote controller 4 through the indoor-device communication unit 34, and information stored in advance in the control unit 31 or the storage unit 33.

The control unit 31 controls air-conditioning operation settings for the indoor device 2, such as the temperature, strength, and direction of the airflow discharged from the indoor device 2 into the room so as to control the operation of the air conditioner 1. The control unit 31 transmits instruction information to the outdoor device 3 in order to control each of the constituent units inside the outdoor device 3.

The control unit 31 includes an indoor-device fan control unit 35 that controls operation of the indoor-device fan 16. The indoor-device fan control unit 35 is a control unit that controls the operation of the indoor-device fan 16, and for example, executes inverter control on the indoor-device fan 16. The indoor-device fan control unit 35 executes control to operate the indoor-device fan 16 at the rotational speed equal to or slower than the maximum fan rotational speed that is an upper limit of the rotational speed of the indoor-device fan 16 determined by the indoor-device fan control unit 35.

On the basis of the temperature of the indoor-device heat exchanger 14 measured by the temperature measurement unit 15, the indoor-device fan control unit 35 determines an upper limit of the rotational speed of the indoor-device fan 16 from candidate upper limits of the rotational speed of the indoor-device fan 16 which are determined in advance. The indoor-device fan control unit 35 executes control to operate the indoor-device fan 16 at a rotational speed equal to or slower than the determined upper limit, and to limit the air temperature within the electrical-component box 13 to a temperature equal to or lower than the lowest rated temperature among the rated temperatures of a plurality of electrical components accommodated in the electrical-component box 13. The control substrate 30 and the temperature measurement unit 15 are connected by a lead. Due to this configuration, the indoor-device fan control unit 35 is capable of communicating with the temperature measurement unit 15, can obtain the temperature of the indoor-device heat exchanger 14 measured by the temperature measurement unit 15, and is capable of constantly monitoring the temperature of the indoor-device heat exchanger 14 through the temperature measurement unit 15.

When the temperature of the indoor-device heat exchanger 14 measured by the temperature measurement unit 15 is equal to or higher than a predetermined first temperature threshold, the indoor-device fan control unit 35 determines the upper limit of the rotational speed of the indoor-device fan 16 to be a predetermined first upper limit. When the temperature of the indoor-device heat exchanger 14 measured by the temperature measurement unit 15 is lower than the first temperature threshold, the indoor-device fan control unit 35 determines the upper limit of the rotational speed of the indoor-device fan 16 to be a predetermined second upper limit that is faster than the first upper limit.

The first temperature threshold is a temperature threshold to determine a set value of the maximum fan rotational speed that is the upper limit of the rotational speed of the indoor-device fan 16. The first temperature threshold is determined in advance and stored in the storage unit 33.

The first upper limit is the maximum fan rotational speed of the indoor-device fan 16, which is determined in advance such that the air temperature within the electrical-component box 13 is kept below the rated temperature of electrical components, and accordingly the temperature of the electrical components within the electrical-component box 13 is kept below the rated temperature of the electrical components, even assuming that the temperature of the indoor-device heat exchanger 14 rises to a maximum extent during heating operation of the air conditioner 1, and heat dissipated from the indoor-device heat exchanger 14 in the indoor device 2 maximizes the rise in air temperature within the electrical-component box 13. That is, the first upper limit is the maximum fan rotational speed that is limited in advance by the rated temperature of the electrical components and the maximum temperature of the indoor-device heat exchanger 14. The rated temperature of the electrical components described herein uses the lowest rated temperature among a plurality of rated temperatures of the electrical components within the electrical-component box 13.

The second upper limit is the maximum fan rotational speed of the indoor-device fan 16, which is determined in advance for a case of operating the indoor-device fan 16 at a rotational speed faster than the first upper limit. That is, the second upper limit is the maximum fan rotational speed of the indoor-device fan 16, which is determined in advance to operate the indoor-device fan 16 with less limitation on the rotational speed within the range where the air temperature within the electrical-component box 13 does not exceed the rated temperature of the electrical components accommodated in the electrical-component box 13. The first temperature threshold, the first upper limit, and the second upper limit are determined by taking into account various conditions such as the rated temperature of the electrical components, and the specifications and capacity of the air conditioner 1.

The data-table storage unit 36 in the storage unit 33 has a data table 41 stored therein. In the data table 41, the relation among the first temperature threshold, the first upper limit, and the second upper limit is set. The indoor-device fan control unit 35 determines the maximum fan rotational speed that is an upper limit of the rotational speed of the indoor-device fan 16 on the basis of the temperature of the indoor-device heat exchanger 14 measured by the temperature measurement unit 15, and on the basis of the first temperature threshold, the first upper limit, and the second upper limit that are set in the data table 41.

An example of the method for determining the first temperature threshold, the first upper limit, and the second upper limit is described below. The first upper limit of the fan rotational speed is determined by results of a temperature-rise test to measure the rise in air temperature within the electrical-component box 13. The test is performed multiple times using a real air conditioner. The temperature-rise test is performed without limiting the rotational speed of the indoor-device fan 16 based on the temperature of the indoor-device heat exchanger 14. That is, the temperature-rise test is performed without controlling the rotational speed of the indoor-device fan 16 on the basis of the temperature of the indoor-device heat exchanger 14 by the indoor-device fan control unit 35 in the air conditioner 1 according to the first embodiment.

On the basis of the results of the temperature-rise tests, the first upper limit is set to a rotational speed of the indoor-device fan 16 at which the air temperature within the electrical component box 13 does not exceed, but is very close to, the rated temperature of the electrical components accommodated in the electrical-component box 13. That is, the first upper limit is set to the highest level of rotational speed such that the air temperature within the electrical component box 13 does not exceed, but is immediately below, the rated temperature of the electrical components accommodated in the electrical-component box 13. The rated temperature of the electrical components described herein uses the lowest rated temperature among a plurality of rated temperatures of the electrical components within the electrical-component box 13. There may be an air conditioner that is brought into a state where the noise level of the indoor-device fan 16 becomes too high before the air temperature within the electrical-component box 13 exceeds the rated temperature of the electrical components accommodated in the electrical-component box 13. In the air conditioner as described above, the rotational speed of the indoor-device fan 16 is limited in accordance with the noise level of the indoor-device fan 16. Therefore, an indoor device of an air conditioner that meets the specifications as described above is not applicable to the control of the rotational speed of the indoor-device fan 16 to be executed by the indoor-device fan control unit 35 in the air conditioner 1 on the basis of the temperature of the indoor-device heat exchanger 14.

The second upper limit is a value required on the basis of the desired air-conditioner capacity. The second upper limit is a rotational speed of the indoor-device fan 16 needed to attain the desired air-conditioner capacity that has been set in designing the functions of the air conditioner. Thus, the second upper limit is determined to be a value that differs depending on the type of air conditioner.

On the basis of the results of the temperature-rise tests, the first temperature threshold is set to a temperature of the indoor-device heat exchanger 14, at which it is possible to rotate the indoor-device fan 16 at the second upper limit without causing any problems.

Figures 4, 5:
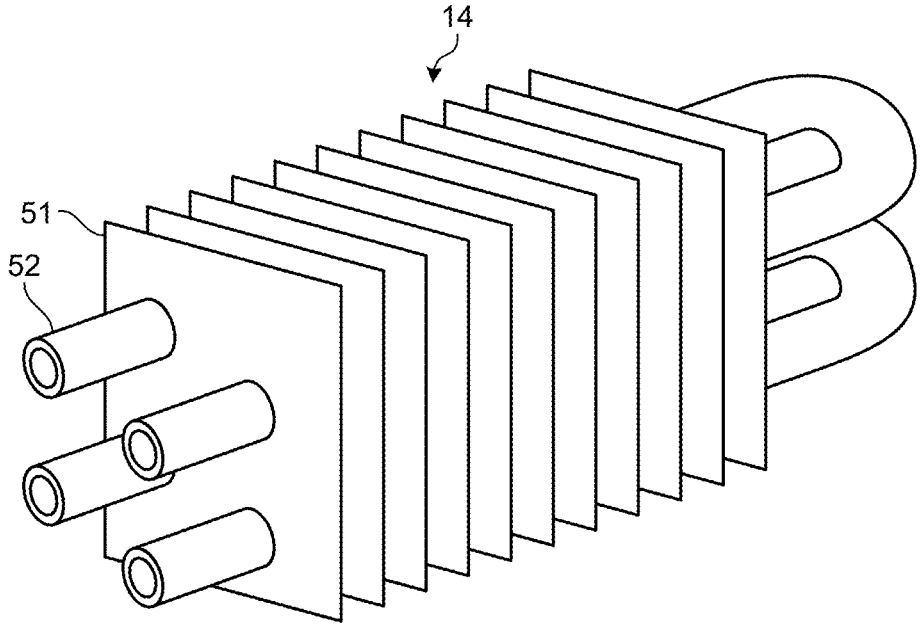
FIG. 4 is a diagram illustrating an example of a data table according to the first embodiment of the present invention.
FIG. 5 is a diagram illustrating an example of an indoor-device heat exchanger according to the first embodiment of the present invention.

FIG. 4 is a diagram illustrating an example of the data table 41 according to the first embodiment of the present invention. In the data table 41 illustrated in FIG. 4, the first temperature threshold is set to 45° C., the first upper limit is set to 1600 rpm, and the second upper limit is set to 1700 rpm. The first temperature threshold, the first upper limit, and the second upper limit are determined in advance and stored as the data table 41 in the data-table storage unit 36 in the storage unit 33.

The indoor-device fan control unit 35 sets and stores the maximum fan rotational speed that is the determined upper limit of the rotational speed of the indoor-device fan 16, in the maximum fan rotational-speed setting storage unit 37 in the storage unit 33. The indoor-device fan control unit 35 executes control to operate the indoor-device fan 16 at a speed equal to or slower than the maximum fan rotational speed that is set in the maximum fan rotational-speed setting storage unit 37.

It is also possible to have a configuration in which an inverter control unit is separately provided to execute inverter control on the indoor-device fan 16 in accordance with an instruction signal transmitted from the indoor-device fan control unit 35. Operation control executed on the indoor-device fan 16 is not limited to the inverter control.

The indoor-device heat exchanger 14 has a function of performing heat exchange between a refrigerant that flows in the indoor-device heat exchanger 14 and the room air, and adjusting the room temperature. FIG. 5 is a diagram illustrating an example of the indoor-device heat exchanger 14 according to the first embodiment of the present invention. In FIG. 5, the indoor-device heat exchanger 14 is a fin-tube heat exchanger that is widely used as an evaporator and a condenser of an air-conditioning device. FIG. 5 illustrates a perspective view in a state where the indoor-device heat exchanger 14 is partially cut off. The indoor-device heat exchanger 14 is constituted of a plurality of fins 51 for a heat exchanger and a heat transfer tube 52. In the indoor-device heat exchanger 14, the fins 51 are spaced with a predetermined gap and provided with the heat transfer tube 52 in a state where the heat transfer tube 52 penetrates through through holes formed on each of the fins 51. The heat transfer tube 52 is a tube connected to the refrigerant pipe 5. A refrigerant flows through the inside of the heat transfer tube 52. The heat transfer tube 52 constitutes a part of the refrigerant circuit in the refrigeration cycle of the air conditioner 1.

The temperature measurement unit 15 measures the temperature of the indoor-device heat exchanger 14 in a predetermined cycle in order to control the rotational speed of the indoor-device fan 16. The temperature measurement unit 15 measures the temperature of the heat transfer pipe 52 of the indoor-device heat exchanger 14 as a temperature of the indoor-device heat exchanger 14. The temperature measurement unit 15 transmits the measured temperature of the indoor-device heat exchanger 14 to the indoor-device fan control unit 35.

The indoor-device fan 16 operates when an indoor propeller 17 is driven by the indoor-device fan motor 18. The rotational speed of the indoor-device fan 16 is controlled by the indoor-device fan control unit 35. The rotational speed of the indoor-device fan 16 can be obtained by, for example, providing a rotational-speed detection device such as an encoder in the indoor-device fan motor 18.

Figure 6:
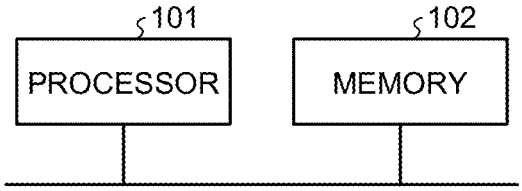
FIG. 6 is a diagram illustrating an example of a hardware configuration of processing circuitry according to the first embodiment of the present invention.

The control unit 31 is implemented as, for example, processing circuitry of a hardware configuration illustrated in FIG. 6. FIG. 6 is a diagram illustrating an example of the hardware configuration of the processing circuitry according to the first embodiment of the present invention. In a case where the control unit 31 is implemented by the processing circuitry illustrated in FIG. 6, the control unit 31 is implemented by, for example, a processor 101 executing a program stored in a memory 102 illustrated in FIG. 6. It is allowable that a plurality of processors and a plurality of memories cooperate with each other to implement the functions of the control unit 31. It is also allowable that a part of the functions of the control unit 31 is implemented as an electronic circuit, while the other parts are implemented by using the processor 101 and the memory 102.

It is further allowable that at least one of the power supply circuit 32, the storage unit 33, and the indoor-device communication unit 34 is implemented by the processor 101 executing a program stored in the memory 102 in the same manner as described above. The processor and the memory used for implementing the control unit 31 may also be used as a processor and a memory for implementing at least one of the power supply circuit 32, the storage unit 33, and the indoor-device communication unit 34. It is also allowable to use a separate processor and a separate memory.

In the outdoor device 3, the four-way valve 19 that changes the flow direction of a refrigerant, the compressor 20 that compresses the refrigerant, the outdoor-device heat exchanger 21 to which the refrigerant pipe 5 is connected, the outdoor-device heat exchanger 21 being an outdoor-side heat exchanger that performs heat exchange between the refrigerant and the outside air, and an outdoor-device fan 22 that generates airflow that passes through the outdoor-device heat exchanger 21 are located in the casing 3*a*. The outdoor-device fan 22 operates when an outdoor propeller 23 is driven by an outdoor-device fan motor 24.

The remote controller 4 is an operation device that sets information necessary for air conditioning by the air conditioner 1, such as the present time, the set temperature that serves as a target room temperature for air conditioning by the air conditioner 1, and the operational mode, and that remotely controls the operation of the air conditioner 1. The remote controller 4 is capable of performing bidirectional information communication with the indoor device 2 through wired communication or wireless communication.

The remote controller 4 includes, as the main constituent elements, a remote-controller control unit that controls operation of the remote controller 4, a remote-controller display unit that displays various types of information related to air-conditioning management in the air conditioner 1 to visually notify a user of the information, a remote-controller operation unit that is an instruction reception unit that receives user-requested setting operation, and a remote-controller communication unit that transmits and receives information to and from the indoor device 2. Each of the constituent units in the remote controller 4 is capable of communicating with each other.

Descriptions are given herein of refrigerant flow during cooling operation and heating operation in the air conditioner 1. During cooling operation, a refrigerant is compressed by the compressor 20 into a high-temperature high-pressure gas refrigerant. The gas refrigerant flows into the outdoor-device heat exchanger 21 through the four-way valve 19. The gas refrigerant exchanges heat with the outside air delivered from the outdoor-device fan 22 in the outdoor-device heat exchanger 21, dissipates heat, and then becomes a high-pressure liquid refrigerant. Thereafter, the liquid refrigerant is expanded to have a predetermined pressure by the expansion valve 25, then becomes a low-pressure gas-liquid two-phase refrigerant, and flows into the indoor-device heat exchanger 14. The gas-liquid two-phase refrigerant having flowed into the indoor-device heat exchanger 14 exchanges heat with the room air delivered from the indoor-device fan 16, absorbs heat, then becomes a low-temperature low-pressure gas refrigerant, and returns to the compressor 20 through the four-way valve 19.

During heating operation, a refrigerant is compressed by the compressor 20 into a high-temperature high-pressure gas refrigerant in the same manner as described above. The gas refrigerant flows into the indoor-device heat exchanger 14 through the four-way valve 19. The gas refrigerant exchanges heat with the room air delivered from the indoor-device fan 16 in the indoor-device heat exchanger 14, dissipates heat, and then becomes a high-pressure liquid refrigerant. Thereafter, the liquid refrigerant is expanded to have a predetermined pressure by the expansion valve 25, then becomes a low-pressure gas-liquid two-phase refrigerant, and flows into the outdoor-device heat exchanger 21. The gas-liquid two-phase refrigerant having flowed into the outdoor-device heat exchanger 21 exchanges heat with the outside air delivered from the outdoor-device fan 22, absorbs heat, then becomes a low-temperature low-pressure gas refrigerant, and returns to the compressor 20 through the four-way valve 19.

Figure 7:
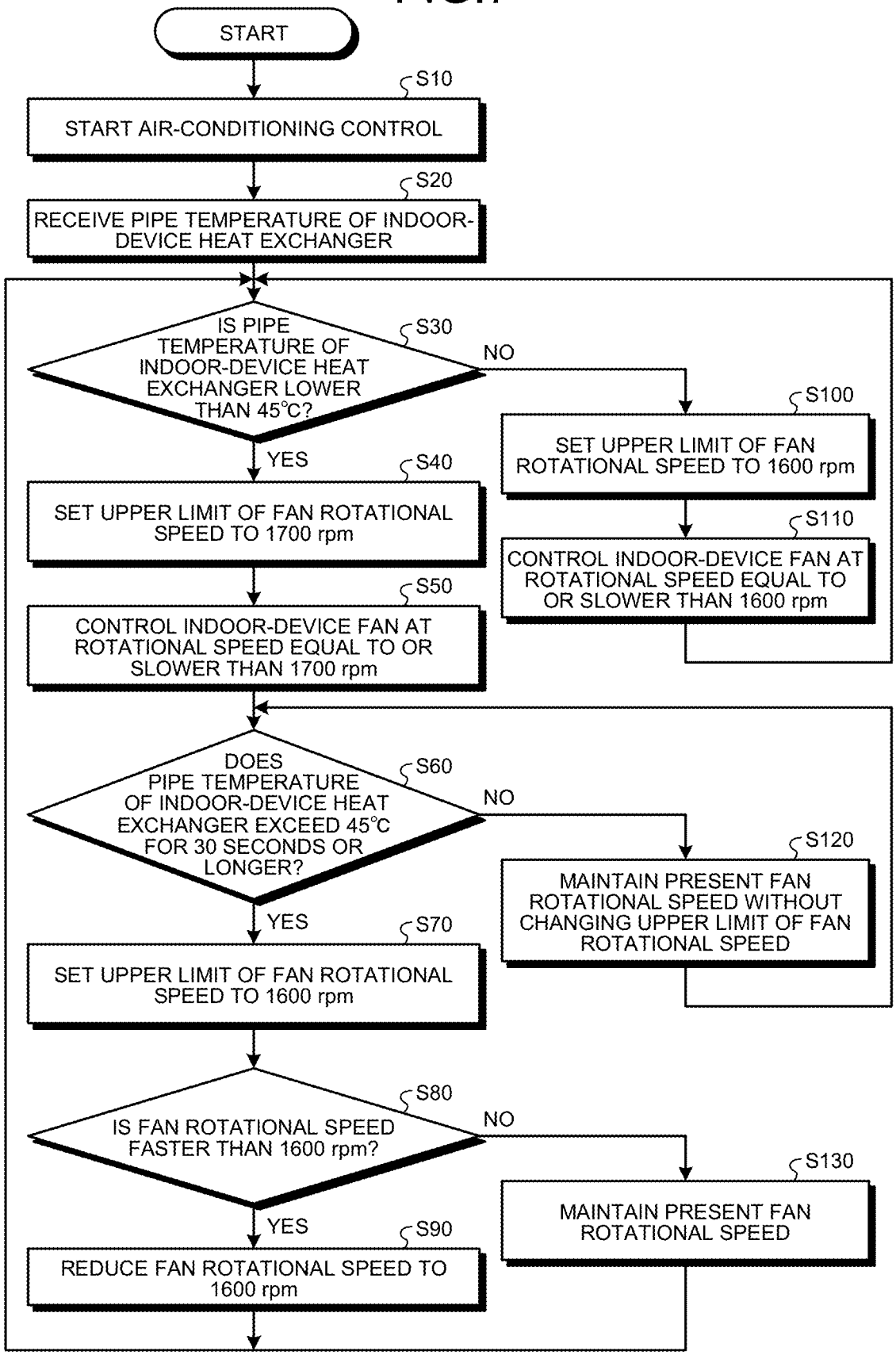
FIG. 7 is a flowchart illustrating a procedure of operation of the air conditioner according to the first embodiment of the present invention to control the rotational speed of an indoor-device fan in the indoor device.

Next, descriptions are given of operation of the air conditioner 1 to control the rotational speed of the indoor-device fan 16 in the indoor device 2 during heating operation. FIG. 7 is a flowchart illustrating a procedure of the operation of the air conditioner 1 according to the first embodiment of the present invention to control the rotational speed of the indoor-device fan 16 in the indoor device 2. A case is described below where the rotational speed of the indoor-device fan 16 is controlled by using conditions stored in the data table 41 illustrated in FIG. 4.

First, when the control unit 31 in the indoor device 2 of the air conditioner 1 receives an infrared signal of heating-start instruction information indicating an instruction to start heating operation of the air conditioner 1 from the remote controller 4, the control unit 31 starts air-conditioning control on the air conditioner 1 at Step S10. That is, the control unit 31 starts controlling each of the constituent units of the indoor device 2 and the outdoor device 3 of the air conditioner 1 to perform air-conditioning operation by the air conditioner 1. It is allowable to have a configuration in which the signal to instruct the control unit 31 in the indoor device 2 to start operation of the air conditioner 1 is transmitted to the control unit 31 by the operation of an operational switch (not illustrated) provided in the indoor device 2. In this case, the control unit 31 starts air-conditioning control on the air conditioner 1 in accordance with the signal transmitted to the control unit 31 by the operation of the operational switch.

The indoor-device fan control unit 35 then controls the temperature measurement unit 15 to start measuring the temperature of the indoor-device heat exchanger 14. That is, the indoor-device fan control unit 35 transmits to the temperature measurement unit 15 temperature-measurement instruction information to instruct the temperature measurement unit 15 to start measuring the temperature of the indoor-device heat exchanger 14.

When the temperature measurement unit 15 receives the temperature-measurement instruction information, the temperature measurement unit 15 starts measuring the temperature of the indoor-device heat exchanger 14 on the basis of the received temperature-measurement instruction information. That is, the temperature measurement unit 15 measures the temperature of the heat transfer pipe 52 that is a pipe temperature of the indoor-device heat exchanger 14 located within the indoor device 2 as a temperature of the indoor-device heat exchanger 14. The temperature measurement unit 15 measures the temperature of the heat transfer pipe 52 in a predetermined cycle, and transmits the measured pipe temperature as a temperature of the indoor-device heat exchanger 14 to the indoor-device fan control unit 35.

At Step S20, the indoor-device fan control unit 35 receives the pipe temperature of the indoor-device heat exchanger 14 transmitted from the temperature measurement unit 15. When the indoor-device fan control unit 35 receives the pipe temperature of the indoor-device heat exchanger 14, the indoor-device fan control unit 35 compares the pipe temperature with the first temperature threshold of 45° C. stored in the data table 41 in the data-table storage unit 36, and then determines whether the pipe temperature of the indoor-device heat exchanger 14 is lower than the first temperature threshold of 45° C. at Step S30.

When the pipe temperature of the indoor-device heat exchanger 14 is equal to or higher than the first temperature threshold of 45° C., that is, NO is determined at Step S30, the indoor-device fan control unit 35 performs Step S100. At Step S100, the indoor-device fan control unit 35 determines a set value of the maximum fan rotational speed of the indoor-device fan 16 to be the first upper limit of 1600 rpm stored in the data table 41, and sets and stores the set value in the maximum fan rotational-speed setting storage unit 37 in the storage unit 33. That is, the indoor-device fan control unit 35 sets the upper limit of the rotational speed of the indoor-device fan 16 to 1600 rpm.

At Step S110, the indoor-device fan control unit 35 executes control to operate the indoor-device fan 16 at the rotational speed equal to or slower than 1600 rpm on the basis of the instruction information transmitted from the remote controller 4 and the information set in the maximum fan rotational-speed setting storage unit 37. The indoor-device fan control unit 35 then returns to Step S30.

The value of 1600 rpm described herein, is the maximum fan rotational speed of the indoor-device fan 16. This value is determined in advance such that when the pipe temperature is equal to or higher than the first temperature threshold of 45° C., the amount of heat generated by a load current of the indoor-device fan 16 is reduced, so that even when the air temperature within the electrical-component box 13 rises significantly due to heat dissipated from the indoor-device heat exchanger 14 in the indoor device 2, the air temperature within the electrical-component box 13 is still kept below the rated temperature of the electrical components, and accordingly the temperature of the electrical components within the electrical-component box 13 is kept below the rated temperature of the electrical components. That is, when the pipe temperature is equal to or higher than the first temperature threshold of 45° C., the indoor-device fan 16 is operated at the rotational speed equal to or slower than 1600 rpm, so that the amount of heat generated by a load current of the indoor-device fan 16 can be decreased as compared to the case of the maximum fan rotational speed of 1700 rpm as described later. This can reduce the rise in air temperature within the electrical-component box 13 despite the significant influence of heat dissipated from the indoor-device heat exchanger 14 in the indoor device 2, and accordingly can keep the temperature of the electrical components within the electrical-component box 13 at the rated temperature or lower. This can prevent the service life of the electrical components within the electrical-component box 13 from being shortened due to the temperature of the electrical components rising above the rated temperature.

Therefore, when the temperature of the indoor-device heat exchanger 14 in the indoor device 2 exceeds the first temperature threshold, the air temperature within the electrical-component box 13 in the indoor device 2 and the temperature of the electrical components are assumed to also rise. Accordingly, the indoor-device fan control unit 35 executes control to set the upper limit of the fan rotational speed of the indoor-device fan 16 to be lower. This can prevent the service life of the electrical components within the electrical-component box 13 from being shortened due to the rise in air temperature within the electrical-component box 13.

In contrast, when the pipe temperature of the indoor-device heat exchanger 14 is lower than the first temperature threshold of 45° C., that is, when YES is determined at Step S30, the indoor-device fan control unit 35 performs Step S40. At Step S40, the indoor-device fan control unit 35 determines a set value of the maximum fan rotational speed of the indoor-device fan 16 to be the second upper limit of 1700 rpm stored in the data table 41, and sets and stores the set value in the maximum fan rotational-speed setting storage unit 37.

At Step S50, the indoor-device fan control unit 35 executes control to operate the indoor-device fan 16 at the rotational speed equal to or slower than 1700 rpm on the basis of the instruction information transmitted from the remote controller 4 and the information set in the maximum fan rotational-speed setting storage unit 37. The indoor-device fan control unit 35 then proceeds to Step S60.

The value of 1700 rpm described herein, is the maximum fan rotational speed of the indoor-device fan 16. This value is determined in advance and designed to operate the indoor-device fan 16 at a rotational speed faster than the first upper limit when the pipe temperature is lower than the first temperature threshold of 45° C. When the pipe temperature is lower than the first temperature threshold of 45° C., the rise in air temperature within the electrical-component box 13 due to heat dissipated from the indoor-device heat exchanger 14 is less significant as compared to a case when the pipe temperature is equal to or higher than the first temperature threshold of 45° C. That is, when the pipe temperature is lower than the first temperature threshold of 45° C., heat dissipated from the indoor-device heat exchanger 14 less affects the rise in temperature of the electrical components within the electrical-component box 13 as compared to the case when the pipe temperature is equal to or higher than the first temperature threshold of 45° C.

For this reason, the rise in air temperature within the electrical-component box 13 and the rise in temperature of the electrical components can both be suppressed even when the amount of heat generated by a load current of the indoor-device fan 16 is increased. By monitoring the temperature of the indoor-device heat exchanger 14 as described later, it is possible to keep the temperature of the electrical components within the electrical-component box 13 at the rated temperature or lower. That is, when the pipe temperature is lower than the first temperature threshold of 45° C., it is possible to keep the temperature of the electrical components within the electrical-component box 13 at the rated temperature or lower by monitoring the temperature of the indoor-device heat exchanger 14 even though the maximum fan rotational speed is set to a greater value as compared to the case when the pipe temperature is equal to or higher than the first temperature threshold of 45° C.

Therefore, when the pipe temperature is lower than the first temperature threshold of 45° C., the indoor-device fan control unit 35 increases the air volume of the indoor-device fan 16 relative to the case when the pipe temperature is equal to or higher than the first temperature threshold of 45° C., and thus sets and stores 1700 rpm in the maximum fan rotational-speed setting storage unit 37. Due to this setting, when the pipe temperature is lower than the first temperature threshold of 45° C., the air conditioner 1 is capable of increasing the air volume of the indoor-device fan 16 as compared to the case when the pipe temperature is equal to or higher than the first temperature threshold of 45° C., and thereby performing higher-capacity and higher-efficiency air conditioning with a greater air volume than that in the case when the pipe temperature is equal to or higher than 45° C.

Next, when the air conditioner 1 continues air-conditioning operation in a state where the maximum fan rotational speed is set to 1700 rpm, the indoor-device fan control unit 35 compares the pipe temperature of the indoor-device heat exchanger 14 transmitted from the temperature measurement unit 15 with the first temperature threshold of 45° C. stored in the data table 41 in the data-table storage unit 36, and then determines whether the pipe temperature continues to exceed the first temperature threshold of 45° C. for 30 seconds or longer at Step S60. That is, the indoor-device fan control unit 35 determines whether the state, where the pipe temperature transmitted from the temperature measurement unit 15 is equal to or higher than the first temperature threshold, continues for a first threshold time that is a predetermined threshold time, or longer.

The first threshold time is a threshold for the indoor-device fan control unit 35 to determine whether to change the maximum fan rotational speed from the second upper limit to the first upper limit. The first threshold time is determined in advance and stored in the indoor-device fan control unit 35. It is allowable that the first threshold time is stored in the storage unit 33.

When the pipe temperature does not continue to exceed the first temperature threshold of 45° C. for 30 seconds or longer, that is, NO is determined at Step S60, the indoor-device fan control unit 35 performs Step S120. At Step S120, the indoor-device fan control unit 35 does not change the upper limit of the fan rotational speed of the indoor-device fan 16, but executes control to maintain the present fan rotational speed. The indoor-device fan control unit 35 then returns to Step S60.

In a case where the pipe temperature is lower than the first temperature threshold of 45° C. and the indoor-device fan 16 is operated with the upper limit of the rotational speed set to 1600 rpm, the temperature of the electrical components mounted on the control substrate 30 does not exceed the rated temperature. However, in a case where the pipe temperature is lower than the first temperature threshold of 45° C. and the indoor-device fan 16 is rotated at a fan rotational speed faster than 1600 rpm, the air temperature within the electrical-component box 13 rises due to the influence of heat dissipated from the indoor-device heat exchanger 14 and the influence of an increase in load current of the indoor-device fan 16, the increase in load current being caused by increasing the rotational speed of the indoor-device fan 16. Therefore, there is a possibility in that the temperature of the electrical components mounted on the control substrate 30 exceeds the rated temperature.

Accordingly, when the pipe temperature continues to exceed the first temperature threshold of 45° C. for 30 seconds or longer, that is, YES is determined at Step S60, the indoor-device fan control unit 35 performs Step S70. At Step S70, the indoor-device fan control unit 35 determines a set upper limit of the fan rotational speed of the indoor-device fan 16 to be the first upper limit of 1600 rpm, and sets and stores the determined upper limit in the maximum fan rotational-speed setting storage unit 37. As described above, the upper limit of the fan rotational speed of the indoor-device fan 16 is decreased to 1600 rpm to thereby decrease the amount of heat generated by a load current of the indoor-device fan 16, so that the temperature of the electrical components can be prevented from exceeding the rated temperature.

Next, at Step S80, the indoor-device fan control unit 35 determines whether the fan rotational speed of the indoor-device fan 16 is faster than 1600 rpm.

When the fan rotational speed of the indoor-device fan 16 is equal to or slower than 1600 rpm, that is, NO is determined at Step S80, the indoor-device fan control unit 35 performs Step S130. At Step S130, the indoor-device fan control unit 35 executes control to maintain the present fan rotational speed. The indoor-device fan control unit 35 then returns to Step S30.

In contrast, when the fan rotational speed of the indoor-device fan 16 is faster than 1600 rpm, that is, YES is determined at Step S80, the indoor-device fan control unit 35 performs Step S90. At Step S90, the indoor-device fan control unit 35 executes control to reduce the fan rotational speed to 1600 rpm. The indoor-device fan control unit 35 then returns to Step S30. The control described above is executed until the control unit 31 receives an infrared signal of heating-stop instruction information indicating an instruction to stop heating operation of the air conditioner 1 from the remote controller 4. When the control unit 31 receives the heating-stop instruction information, the control unit 31 executes control to stop each of the constituent units of the indoor device 2 and the outdoor device 3 including the indoor-device fan 16.

In the control method illustrated in the flowchart in FIG. 7, when the pipe temperature becomes lower than the first temperature threshold of 45° C. for a second threshold time that is a predetermined threshold time, or longer, then it is allowable to perform the step of setting the maximum fan rotational speed, that is an upper limit of the fan rotational speed of the indoor-device fan 16, to the second upper limit of 1700 rpm again after Step S90 and Step S130. It is possible to set or change the second threshold time to any value through the remote controller 4 in accordance with various conditions such as the specifications and capacity of the air conditioner 1. The second threshold time may be equal to or different from the first threshold time described above. In this case, the temperature threshold is not necessarily the first temperature threshold of 45° C.

For example, the indoor-device fan control unit 35 determines whether the pipe temperature becomes lower than the first temperature threshold of 45° C. for the second threshold time of 30 seconds that is a predetermined threshold time, or longer after the fan rotational speed has been reduced to 1600 rpm at Step S90. When the pipe temperature becomes lower than the first temperature threshold of 45° C. for 30 seconds or longer, the indoor-device fan control unit 35 determines the maximum fan rotational speed that is an upper limit of the fan rotational speed of the indoor-device fan 16 to be 1700 rpm again, and then sets and stores the determined maximum fan rotational speed in the maximum fan rotational-speed setting storage unit 37. The indoor-device fan control unit 35 executes control to operate the indoor-device fan 16 at the rotational speed equal to or slower than 1700 rpm on the basis of the instruction information transmitted from the remote controller 4 and the information set in the maximum fan rotational-speed setting storage unit 37. The indoor-device fan control unit 35 then returns to Step S60. When the pipe temperature does not become lower than 45° C. for 30 seconds or longer, the indoor-device fan control unit 35 repeats the determination of whether the pipe temperature becomes lower than 45° C. for 30 seconds or longer.

It is also allowable that the first temperature threshold and a second temperature threshold that are temperature thresholds used for the above control, have hysteresis characteristics. When the temperature threshold has hysteresis characteristics, this can prevent a hunting phenomenon in which the fan rotational speed of the indoor-device fan 16 is frequently changed due to fluctuations in the pipe temperature of the indoor-device heat exchanger 14 around the temperature threshold.

As described above, the air conditioner 1 according to the first embodiment determines an upper limit of the fan rotational speed of the indoor-device fan 16 and controls the rotational speed of the indoor-device fan 16 based on the assumption that when the temperature of the indoor-device heat exchanger 14 becomes equal to or higher than the first temperature threshold, the air temperature within the electrical-component box 13 and the temperature of the electrical components also rise. That is, when the pipe temperature of the indoor-device heat exchanger 14 is equal to or higher than the first temperature threshold, the indoor-device fan control unit 35 executes control to operate the indoor-device fan 16 at the rotational speed equal to or slower than the first upper limit of 1600 rpm. When the pipe temperature of the indoor-device heat exchanger 14 is lower than the first temperature threshold, the indoor-device fan control unit 35 executes control to operate the indoor-device fan 16 at the rotational speed equal to or slower than the second upper limit of 1700 rpm that is a rotational speed faster than the first upper limit.

That is, the air conditioner 1 controls the rotational speed of the indoor-device fan 16 correspondingly to the temperature of the indoor-device heat exchanger 14, so that when the indoor-device heat exchanger 14 dissipates a smaller amount of heat and accordingly the temperature of the indoor-device heat exchanger 14 is lower than the first temperature threshold, the air conditioner 1 can raise the upper limit of the rotational speed of the indoor-device fan 16, which is limited by the rated temperature of the electrical components. Due to this control, when the rise in air temperature within the electrical-component box 13 due to heat dissipated from the indoor-device heat exchanger 14 in the indoor device 2 is small, the air conditioner 1 operates the indoor-device fan 16 at a rotational speed faster than that in the case when the rise in air temperature within the electrical-component box 13 due to heat dissipated from the indoor-device heat exchanger 14 is large, in order to increase the air volume of the indoor-device fan 16 so that the air conditioner 1 can perform high-capacity and high-efficiency air conditioning.

The air conditioner 1 configured as described above can obtain an effect of reducing the rise in air temperature within the electrical-component box 13 by reducing heat generation by a load current of the indoor-device fan 16 when the temperature of the indoor-device heat exchanger 14 is equal to or higher than the first temperature threshold, and thus preventing the temperature of the electrical components within the electrical-component box 13 from exceeding the rated temperature. The air conditioner 1 can also obtain an effect of performing high-capacity and high-efficiency air conditioning by increasing the air volume of the indoor-device fan 16 when the temperature of the indoor-device heat exchanger 14 is lower than the first temperature threshold. Even when the air volume of the indoor-device fan 16 is increased, the air conditioner 1 adjusts the rotational speed of the indoor-device fan 16 on the basis of the temperature of the indoor-device heat exchanger 14, and thus can still keep the temperature of the electrical components within the electrical-component box 13 at the rated temperature or lower.

Therefore, the air conditioner 1 according to the first embodiment is capable of operating the indoor-device fan 16 such that it is possible to reduce the rise in temperature of the electrical components within the electrical-component box 13, the service life of the electrical components is prevented from being shortened due to the rise in air temperature within the electrical-component box 13, and the limitation on the rotational speed of the indoor-device fan 16 is eased without causing the temperature of the electrical components mounted on the control substrate 30 to exceed the rated temperature.

Second Embodiment

In the first embodiment described above, the case is described where the maximum fan rotational speed that is an upper limit of the fan rotational speed of the indoor-device fan 16 is set to one of the two values, 1600 rpm and 1700 rpm. However, it is also possible to select the maximum fan rotational speed from among three or more candidate rotational speeds. FIG. 8 is a diagram illustrating an example of a data table 42 according to a second embodiment of the present invention. In the data table 42, the relation among the first temperature threshold, the first upper limit, and the second upper limit, which can be used in the air conditioner 1, is set similarly to the data table 41.

The data table 42 illustrated in FIG. 8 has a plurality of different temperature thresholds stored therein. That is, in the data table 42 illustrated in FIG. 8, a first temperature threshold is set to 45° C., a second temperature threshold is set to 40° C., and a third temperature threshold is set to 35° C. in descending order of temperature. In the data table 42 illustrated in FIG. 8, the first upper limit and the second upper limit are set corresponding to each of the different temperature thresholds. That is, in the data table 42 illustrated in FIG. 8, the first upper limit is set to 1600 rpm and the second upper limit is set to 1700 rpm corresponding to the first temperature threshold of 45° C. The first upper limit is set to 1700 rpm and the second upper limit is set to 1800 rpm corresponding to the second temperature threshold of 40° C. The first upper limit is set to 1800 rpm and the second upper limit is set to 1900 rpm corresponding to the third temperature threshold of 35° C.

Figure 9:
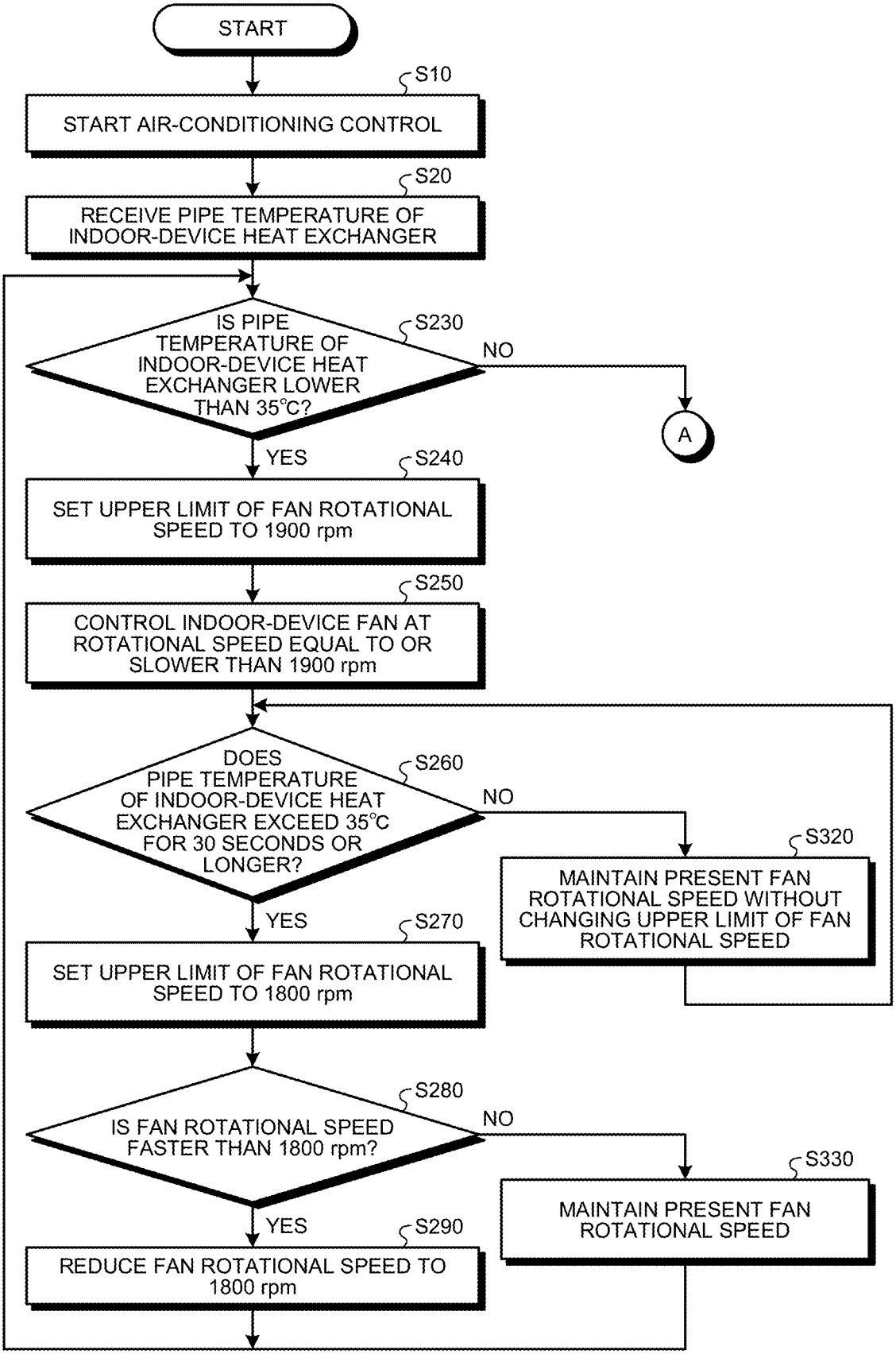
FIG. 9 is a flowchart illustrating a procedure of operation to control the rotational speed of an indoor-device fan in the second embodiment of the present invention.
Figure 10:
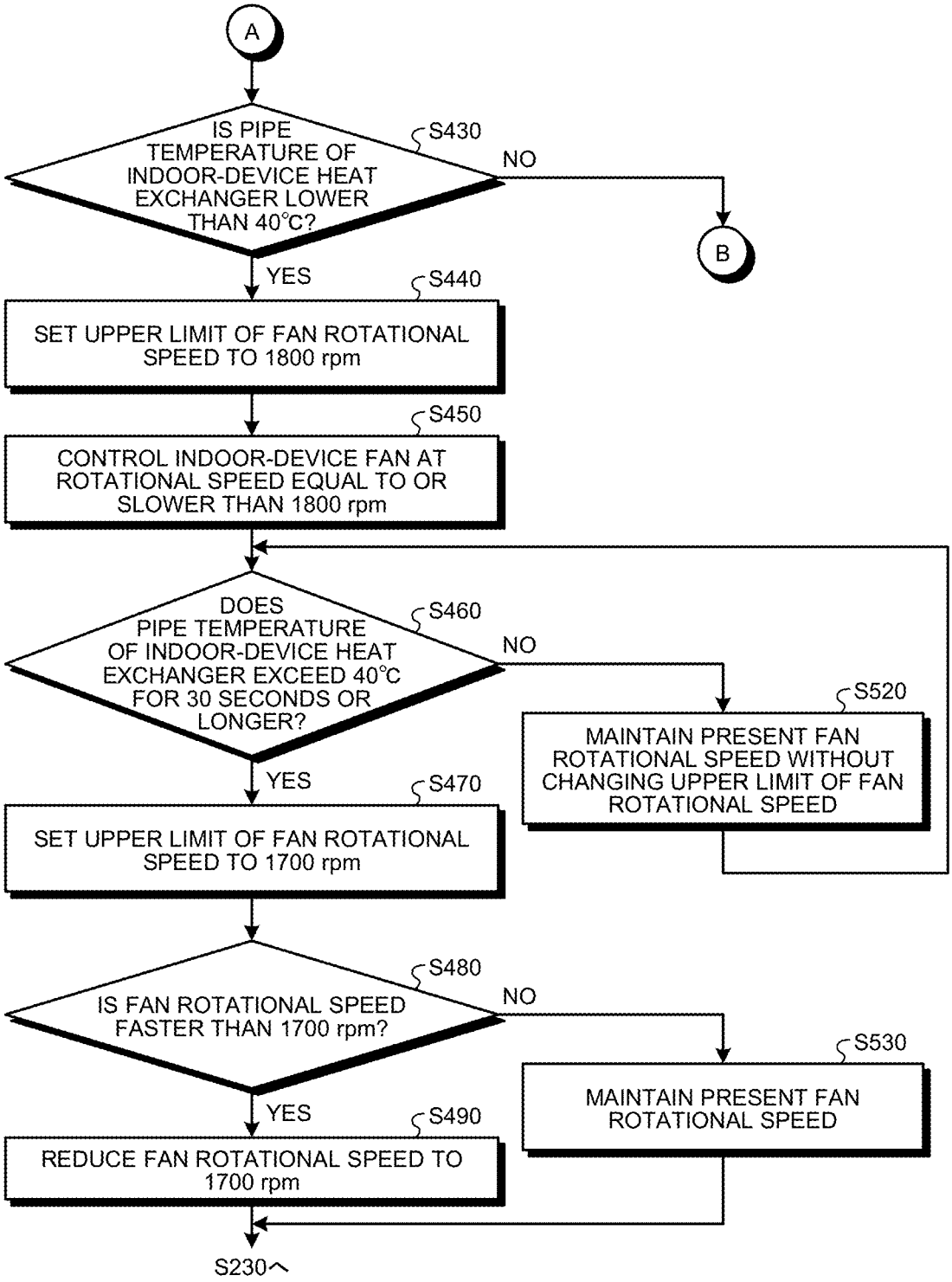
FIG. 10 is a flowchart illustrating a procedure of the operation to control the rotational speed of the indoor-device fan in the second embodiment of the present invention.
Figure 11:
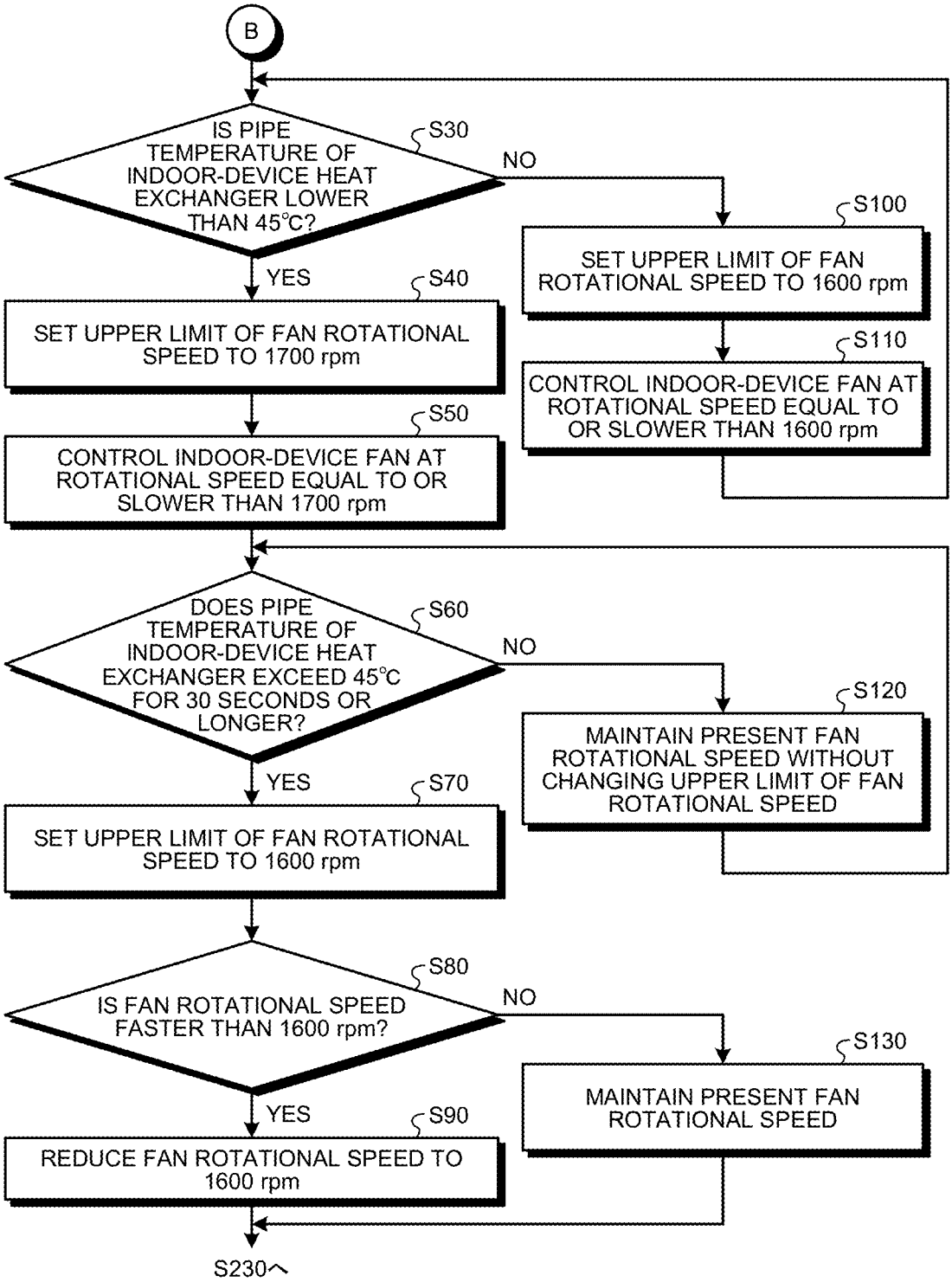
FIG. 11 is a flowchart illustrating a procedure of the operation to control the rotational speed of the indoor-device fan in the second embodiment of the present invention.

Next, descriptions are given of a case where the air conditioner 1 controls the rotational speed of the indoor-device fan 16 by using conditions stored in the data table 42 illustrated in FIG. 8. FIGS. 9 to 11 are flowcharts illustrating a procedure of the operation to control the rotational speed of the indoor-device fan 16 in the second embodiment. In FIGS. 9 to 11, like steps to those illustrated above in the flowchart in FIG. 7 are denoted by like step numbers to those in FIG. 7.

First, the control unit 31 in the indoor device 2 of the air conditioner 1 performs Step S10 and Step S20 in the same manner as in the first embodiment.

Next, the indoor-device fan control unit 35 performs Step S230 to Step S290, Step S320, and Step S330 in the same manner as at Step S30 to Step S90, Step S120, and Step S130, except that the indoor-device fan control unit 35 uses the third temperature threshold of 35° C. instead of the first temperature threshold of 45° C. In this case, the first upper limit is set to 1800 rpm instead of 1600 rpm. The second upper limit is set to 1900 rpm instead of 1700 rpm. After Step S290 and after S330, the indoor-device fan control unit 35 performs Step S230.

When NO is determined at Step S230, the indoor-device fan control unit 35 executes control in accordance with the procedure of the flowchart illustrated in FIG. 10. That is, the indoor-device fan control unit 35 performs Step S430 to Step S490, Step S520, and Step S530 in the same manner as at Step S30 to Step S90, Step S120, and Step S130, except that the indoor-device fan control unit 35 uses the second temperature threshold of 40° C. instead of the first temperature threshold of 45° C. In this case, the first upper limit is set to 1700 rpm instead of 1600 rpm. The second upper limit is set to 1800 rpm instead of 1700 rpm. After Step S490 and after S530, the indoor-device fan control unit 35 performs Step S230.

When NO is determined at Step S430, the indoor-device fan control unit 35 executes control in accordance with the procedure of the flowchart illustrated in FIG. 11. That is, the indoor-device fan control unit 35 performs Step S30 to Step S130. After Step S90 and after S130, the indoor-device fan control unit 35 performs Step S230.

In the second embodiment of the present invention, by executing the control described above, the air conditioner 1 can determine the first upper limit and the second upper limit which differ depending on the temperature zone of the pipe temperature of the indoor-device heat exchanger 14. Due to this determination, the air conditioner 1 can further ease the limitation on the maximum rotational speed of the indoor-device fan 16, which is limited by the rated temperature of the electrical components mounted on the control substrate 30, correspondingly to the temperature zone of the pipe temperature of the indoor-device heat exchanger 14. Therefore, the air conditioner 1 is capable of operating the indoor-device fan 16 such that it is possible to suppress the rise in air temperature and temperature of the electrical components within the electrical-component box 13, the service life of the electrical components is prevented from being shortened due to the rise in temperature within the electrical-component box 13, and the limitation on the rotational speed of the indoor-device fan 16 is further eased within the range where the temperature of the electrical components mounted on the control substrate 30 does not exceed the rated temperature.

The configurations described in the above embodiments are only examples of the content of the present invention. The configurations can be combined with other well-known techniques, and part of each of the configurations can be omitted or modified without departing from the scope of the present invention.

The invention claimed is:

1. An air conditioner that includes an indoor device including inside a casing an electrical-component box having electrical components accommodated therein, an indoor-device heat exchanger, and an indoor-device fan to deliver air to the indoor-device heat exchanger, the air conditioner comprising:

a temperature measurement device to measure a temperature of the indoor-device heat exchanger;

a processor; and a memory to store a program which, when executed by the processor, performs processes of:

determining an upper limit of a rotational speed of the indoor-device fan on a basis of a temperature of the indoor-device heat exchanger measured by the temperature measurement device, and executing control to operate the indoor-device fan at a rotational speed equal to or slower than the determined upper limit so as to limit an air temperature within the electrical-component box to a temperature equal to or lower than a rated temperature of the electrical components, wherein when a temperature of the indoor-device heat exchanger is equal to or higher than a predetermined temperature threshold, the processor determines the upper limit to be a predetermined first upper limit, and when a temperature of the indoor-device heat exchanger is lower than the temperature threshold, the processor determines the upper limit to be a predetermined second upper limit that is faster than the first upper limit.

2. The air conditioner according to claim 1, wherein the processor determines the upper limit to be the first upper limit when a state, where a temperature of the indoor-device heat exchanger is equal to or higher than the temperature threshold, continues for a predetermined threshold time or longer after the processor has determined the upper limit to be the second upper limit.

3. The air conditioner according to claim 1, wherein the memory stores a data table in which a relation among the temperature threshold, the first upper limit, and the second upper limit is set.

4. The air conditioner according to claim 3, wherein in the data table, a plurality of the temperature thresholds that are different from each other, and the first upper limit and the second upper limit corresponding to each of the different temperature thresholds are set.

5. The air conditioner according to claim 2, wherein the memory stores a data table in which a relation among the temperature threshold, the first upper limit, and the second upper limit is set.

6. The air conditioner according to claim 5, wherein in the data table, a plurality of the temperature thresholds that are different from each other, and the first upper limit and the second upper limit corresponding to each of the different temperature thresholds are set.

* * * * *